US011013980B2

(12) United States Patent
Nichols et al.

(10) Patent No.: US 11,013,980 B2
(45) Date of Patent: May 25, 2021

(54) SKI SUSPENSION SYSTEM AND METHOD

(71) Applicants: Kenneth Nichols, San Carlos, CA (US); Nicholas W Foster, Jr., Indianapolis, IN (US)

(72) Inventors: Kenneth Nichols, San Carlos, CA (US); Nicholas W Foster, Jr., Indianapolis, IN (US)

( * ) Notice: Subject to any disclaimer, the term of this patent is extended or adjusted under 35 U.S.C. 154(b) by 0 days.

(21) Appl. No.: 16/703,040

(22) Filed: Dec. 4, 2019

(65) Prior Publication Data

US 2020/0222787 A1 Jul. 16, 2020

Related U.S. Application Data

(60) Provisional application No. 62/792,031, filed on Jan. 14, 2019.

(51) Int. Cl.
*A63C 5/075* (2006.01)
*A63C 9/00* (2012.01)

(52) U.S. Cl.
CPC ..... *A63C 5/075* (2013.01); *A63C 9/003* (2013.01)

(58) Field of Classification Search
CPC ..... A63C 5/075; A63C 9/003
See application file for complete search history.

(56) References Cited

U.S. PATENT DOCUMENTS 3,865,389 A 2/1975 Delery
4,979,761 A 12/1990 Rohlin
5,046,751 A 9/1991 Scherübl
5,135,250 A 8/1992 Abondance et al.
5,636,855 A 6/1997 Couderc et al.
5,687,982 A 11/1997 Challande et al.
5,931,480 A 8/1999 Schroeder
6,158,747 A * 12/2000 Magnani ..... A63C 5/075 280/11.14
7,431,323 B2 10/2008 Holzer et al.
8,246,070 B2 8/2012 Lin
9,452,343 B2 9/2016 Schröer et al.
9,950,242 B2 4/2018 Wilson
9,981,178 B1 5/2018 Huynh
2002/0096860 A1* 7/2002 Lowe ..... A63C 5/07 280/602
2004/0026894 A1 2/2004 Gyr
2004/0178606 A1 9/2004 Ashley
2004/0227311 A1 11/2004 Sanders
2005/0212258 A1 9/2005 Enders
(Continued)

FOREIGN PATENT DOCUMENTS

WO WO 2013/006874 A1 1/2013

OTHER PUBLICATIONS

ISA/US; International Search Report and Written Opinion; PCT/US2019/064421; dated Feb. 6, 2020.

*Primary Examiner* — Brian L Swenson
(74) *Attorney, Agent, or Firm* — Kirk A. Wilson; Joseph T. Guy; Patent Filing Specialist Inc.

(57) ABSTRACT

Device and methods for a ski assembly system and snowboard assembly system having a ski or snowboard with a centerline axis, a perpendicular axis, and a ski suspension system. The ski or snowboard suspension system has a suspension platform with two or more struts rotatably coupled with the suspension platform and at least one of a front mount assembly and a rear mount assembly.

19 Claims, 10 Drawing Sheets

(56) References Cited

U.S. PATENT DOCUMENTS

| | | | | |
|---|---|---|---|---|
| 2007/0182129 | A1* | 8/2007 | Wilson | A63C 5/0485 280/602 |
| 2009/0267324 | A1 | 10/2009 | Macek | |
| 2010/0194076 | A1 | 8/2010 | Wilson | |
| 2010/0320731 | A1 | 12/2010 | Wilson | |
| 2011/0025021 | A1* | 2/2011 | Sitar | A63C 9/003 280/617 |
| 2011/0121543 | A1 | 5/2011 | Lyons | |
| 2013/0106068 | A1* | 5/2013 | Franko | A63C 17/062 280/11.15 |
| 2013/0181427 | A1 | 7/2013 | Fritschi | |
| 2014/0312597 | A1 | 10/2014 | Wilson | |
| 2017/0246526 | A1* | 8/2017 | Linzmeier | A63C 9/003 |

* cited by examiner

SKI SUSPENSION SYSTEM AND METHOD

CROSS-REFERENCE TO RELATED APPLICATIONS

The present invention claims priority to U.S. Provisional Patent Application No. 62/792,031, filed Jan. 14, 2019, which is incorporated herein by reference in its entirety.

FIELD OF THE DISCLOSURE

This disclosure relates generally to devices and methods for a suspension system that absorbs shock and vibrations generated during skiing or snowboarding. The suspension system is coupled with the ski and each ski boot mounts on a suspension platform to maneuver the ski or snowboard. The suspension system includes struts that can comprise at least one of a shock absorber, a bump stop, a spring, a reservoir, and combinations thereof.

BACKGROUND OF THE DISCLOSURE

Skiing and snowboarding are inherently dangerous and hard on the body. At any speed, regardless of terrain, the upper body is subjected to numerous jolts and impacts which the legs cannot effectively deal with. Such impacts engender fatigue in the skier, and create chatter and loss of contact with the snow. This alters performance significantly, and often culminates in physical injury.

Since impact force is the overall force divided by the time of force application, the ideal way to attenuate impact forces is by prolonging, and thereby lessening, the immediate force of impact. This is most efficiently done by allowing for "travel" anywhere between the ski and the upper body. The skier's legs do some of this work, but peak impact loads are more efficiently dampened somewhere between the binding and the ski, not via the skier's legs. A system which offers vertical travel concurrent with positive edge control is optimal.

Several methods for providing ski suspension are known in the prior art. Some provide ineffective suspension, while others are too complex or heavy, or their suspension rate and dampening are not adjustable to skiing conditions or the weight of the skier. Ski tip dampeners and ski tension adjusters are also known, but none of them are generally adaptable as after-market additions to most skis.

A snowboard also generates shock and vibrations during use that are transmitted to the user which adversely affect the ride experienced by the user. The adverse effects are amplified when the snowboard is used on steep slopes, during sharp turns, in order to control the speed of the snowboard. The adverse effects are further exacerbated if the slope contains hard snow and/or the course includes moguls.

It would therefore be advantageous to provide an adjustable suspension device for use on skis, snowboards and the like, to provide more comfort, speed, and edge control for the user.

BRIEF SUMMARY OF THE INVENTION

A ski assembly comprising a ski with a centerline axis, a perpendicular axis, and a ski running surface; at least one ski boot comprising a ski binding and a ski boot sole; and a ski suspension system having a suspension platform and two or more struts extending between the suspension platform and a front mount assembly or a rear mount assembly, each strut comprising a first end and a second end, each of the two or more struts rotatably coupled with the suspension platform on the first end, and rotatably coupled with the front mount assembly or the rear mount assembly on the second end. The suspension platform and the ski are coupled such that there is an adjustable central clearance between the ski running surface and the ski boot sole. Resultant forces between the ski and the suspension platform are exerted only via the two or more struts. The suspension platform is configured to absorb shock and vibration generated during use of the ski assembly.

A method of absorbing shock and vibration generated during use of a ski assembly, comprises the steps of; coupling at least one ski boot of a skier to a ski binding, the ski binding coupled with a ski assembly comprising a ski and a ski suspension system, the ski suspension system further comprising a suspension platform and two or more struts extending between the suspension platform and a front mount assembly or a rear mount assembly, each strut comprising a first end and a second end, each of the two or more struts rotatably coupled with the suspension platform on the first end, and rotatably coupled with the front mount assembly or the rear mount assembly on the second end; adjusting the central clearance between a ski running surface and a ski boot sole; and applying resultant front and rear forces through the ski suspension system only via the two or more struts to absorb shock and vibration generated during use of the ski assembly.

DETAILED DESCRIPTION OF THE INVENTION

Figure 1:
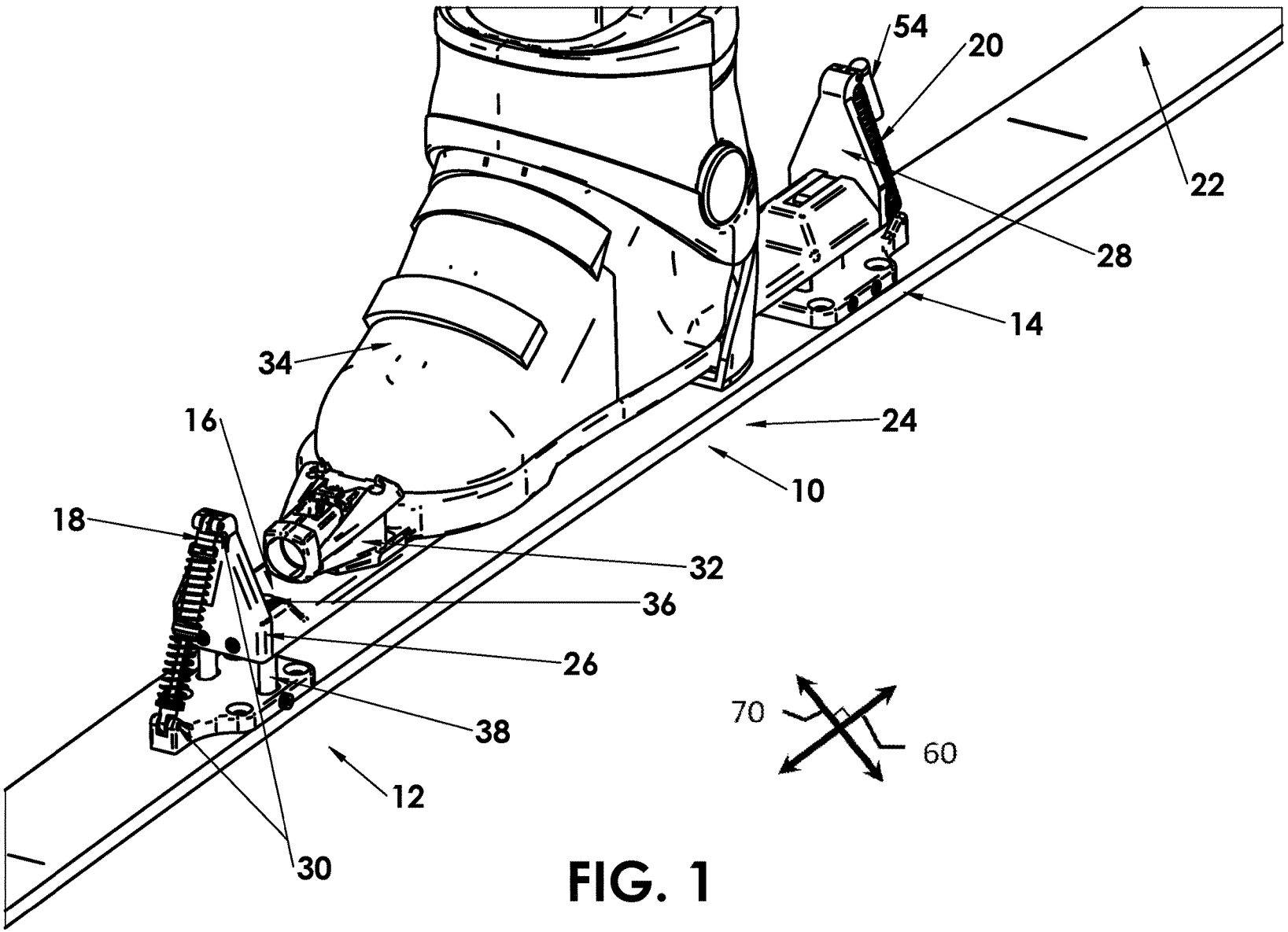
FIG. 1 illustrates a perspective view of an exemplary ski assembly.

The ski assembly 10, illustrated in the figures, comprises a suspension system 24 that connects to a ski 22, snowboard or glider body so as to apply a resultant downward force to the front and rear of the ski 22 body. The suspension system 24 may apply the force before and/or during flexure of the ski body. The suspension system 24 may be configured so that the downward force of the skier's weight is applied only at a front mount assembly 12 and a rear mount assembly 14 along the length of the ski body, with no other connection points between the suspension system and the ski body. The suspension system creates a larger central clearance 46 to accommodate suspension system travel, and independently applies pressure to the front and rear such that the front and rear will be kept constantly pressured and curved onto the snow. The front mount assembly 12 can be configured with posts 38 positioned equidistant from the centerline axis 60 to stabilize the suspension system and enable establishing the resultant downward tip force on the edges of the ski 22 for turning. The rear mount assembly 14 can be configured with a rear guide block 42 positioned on the centerline axis 60 to further stabilize the suspension system and enable establishing the resultant downward heel force on the centerline axis 60 of the ski 22.

Figure 2:
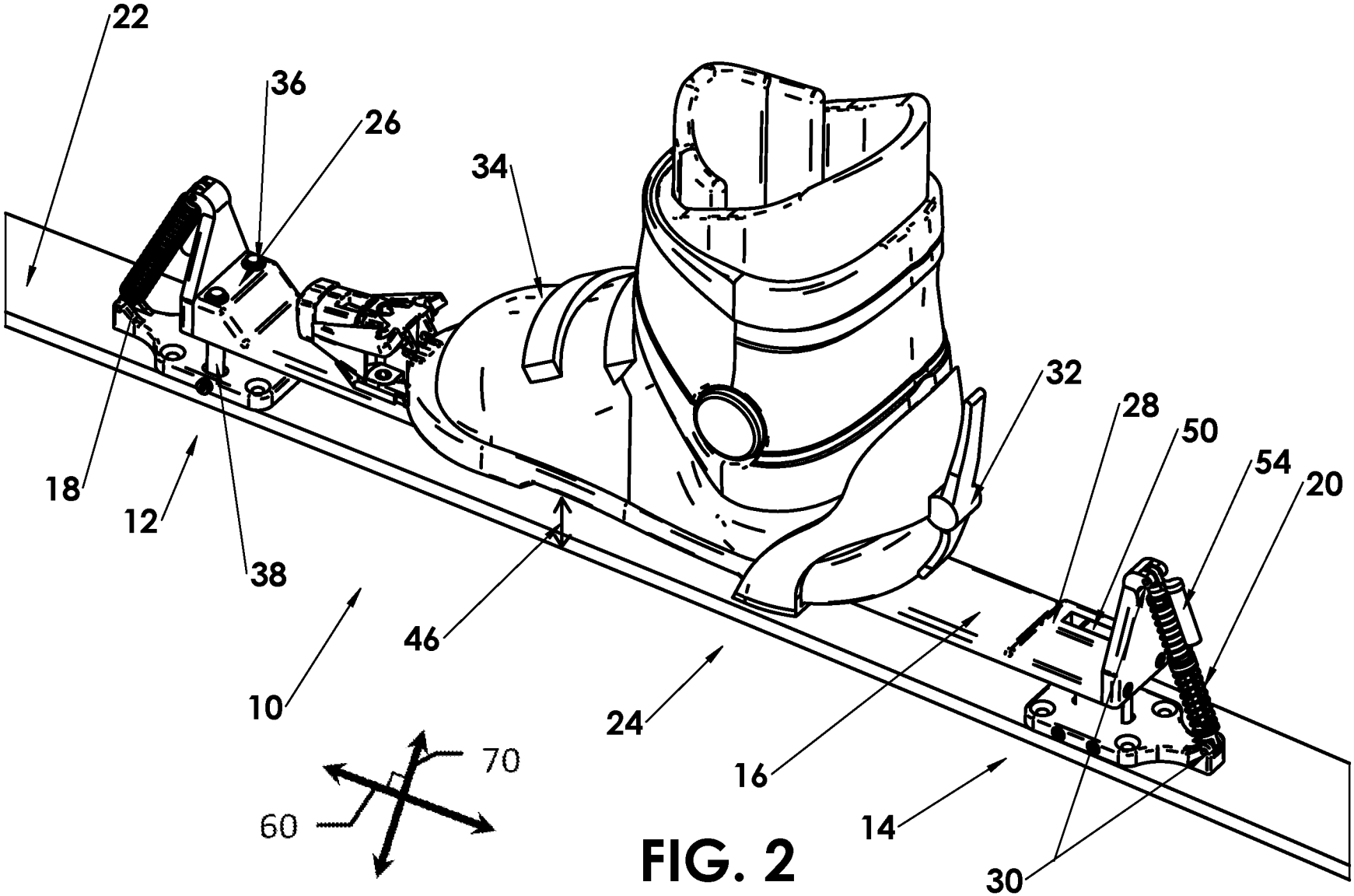
FIG. 2 illustrates another perspective view of an exemplary ski assembly.

FIGS. 1 and 2 depict perspective views of an embodiment of a ski assembly 10 according to the present invention. The ski assembly 10 comprises a ski 22 and a suspension system 24. The suspension system 24 comprises a suspension platform 16, four struts, two front struts 18 and two rear struts 20, and eight rotatable couplings 30. Each strut is coupled with the ski 22 at a front mount assembly 12 or rear mount assembly 14 and coupled with the suspension platform 16 at a front platform projection 26 or a rear platform projection 28. In this embodiment, a centerline axis 60 is defined as parallel with the length of the ski 22 and centered on the width of the ski 22. A perpendicular axis 70 is defined as perpendicular to the centerline axis 60 ski 22. The suspension platform 16 operates to absorb shock and vibration generated during use of the ski assembly 10 so as to provide a smoother ride for users of the ski assembly 10. Each suspension platform 16, front mount assembly 12, and rear mount assembly 14 may be made from a metal, composite material or other suitable material compatible with conventional ski construction. Each suspension platform 16 can include a ski binding 32 configured to secure a ski boot 34 to the suspension platform 16. The ski binding 32 is configured to release the ski boot 34 from the suspension platform 16 when pressure exerted on the ski binding 32 exceeds the release settings.

Figure 3:
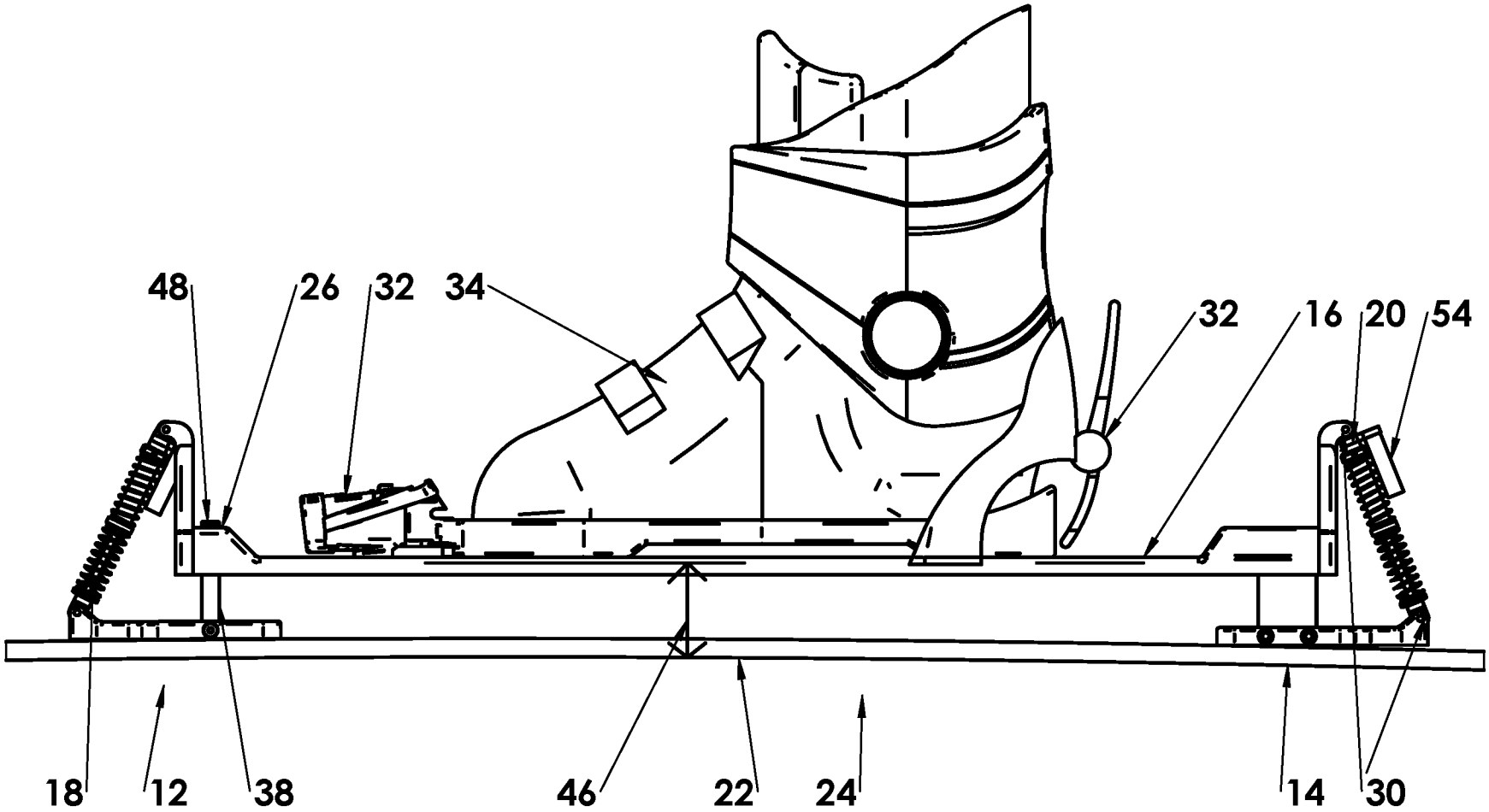
FIG. 3 illustrates a side view of an exemplary ski assembly.

FIG. 3 illustrates a side view of an embodiment of a ski assembly 10. Components are similar to those shown in FIGS. 1 and 2. The central clearance 46 is shown and defined as the distance between the bottom of the running surface of the ski 22 and the ski boot 34 sole. The central clearance 46 can be adjusted to a predetermined maximum height, thereby limiting travel of the suspension system 24 to the predetermined maximum height.

Figure 4:
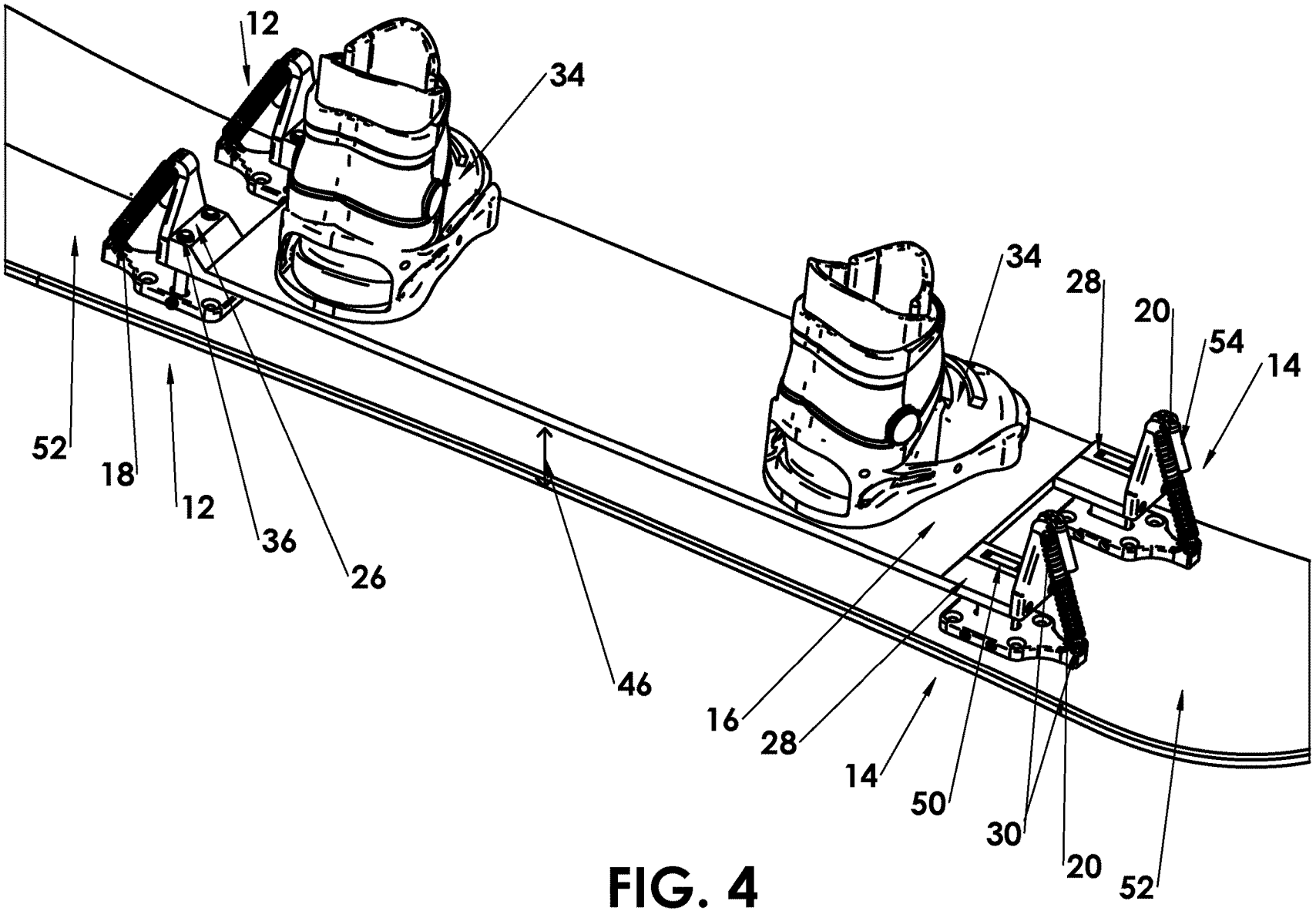
FIG. 4 illustrates a perspective view of and exemplary snowboard assembly.
Figure 9:
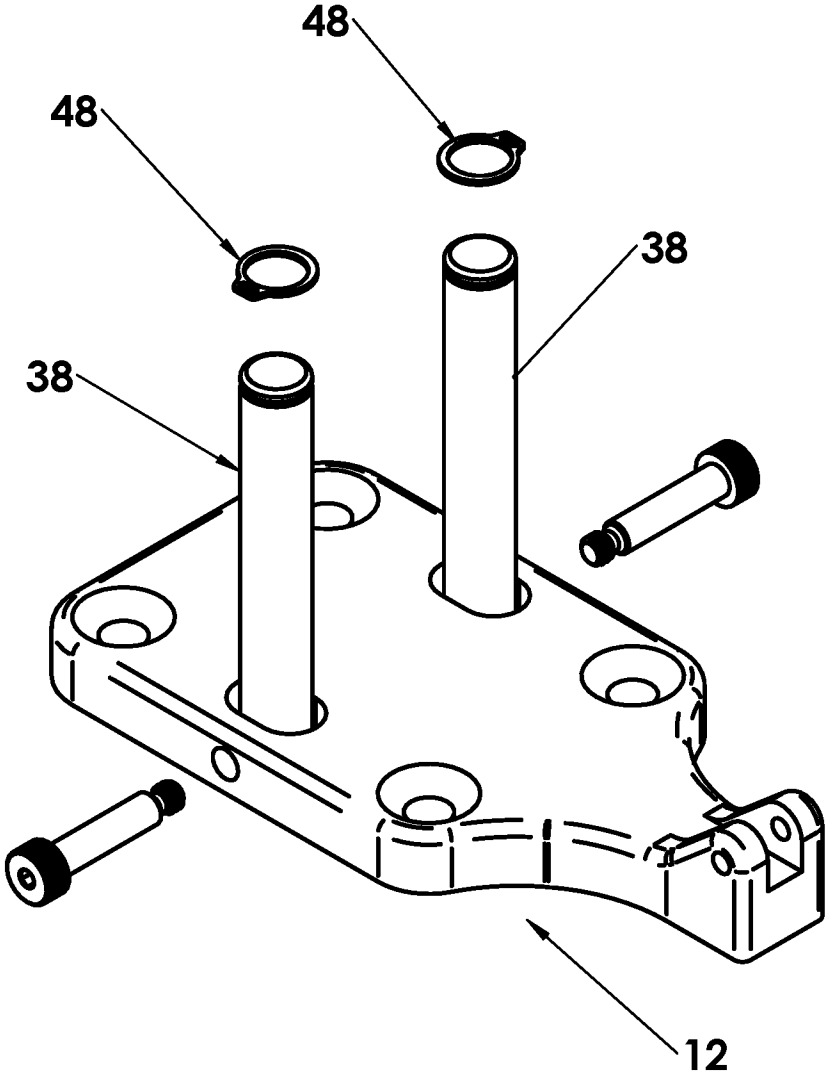
FIG. 9 illustrates an exemplary front mount plate.
Figure 10:
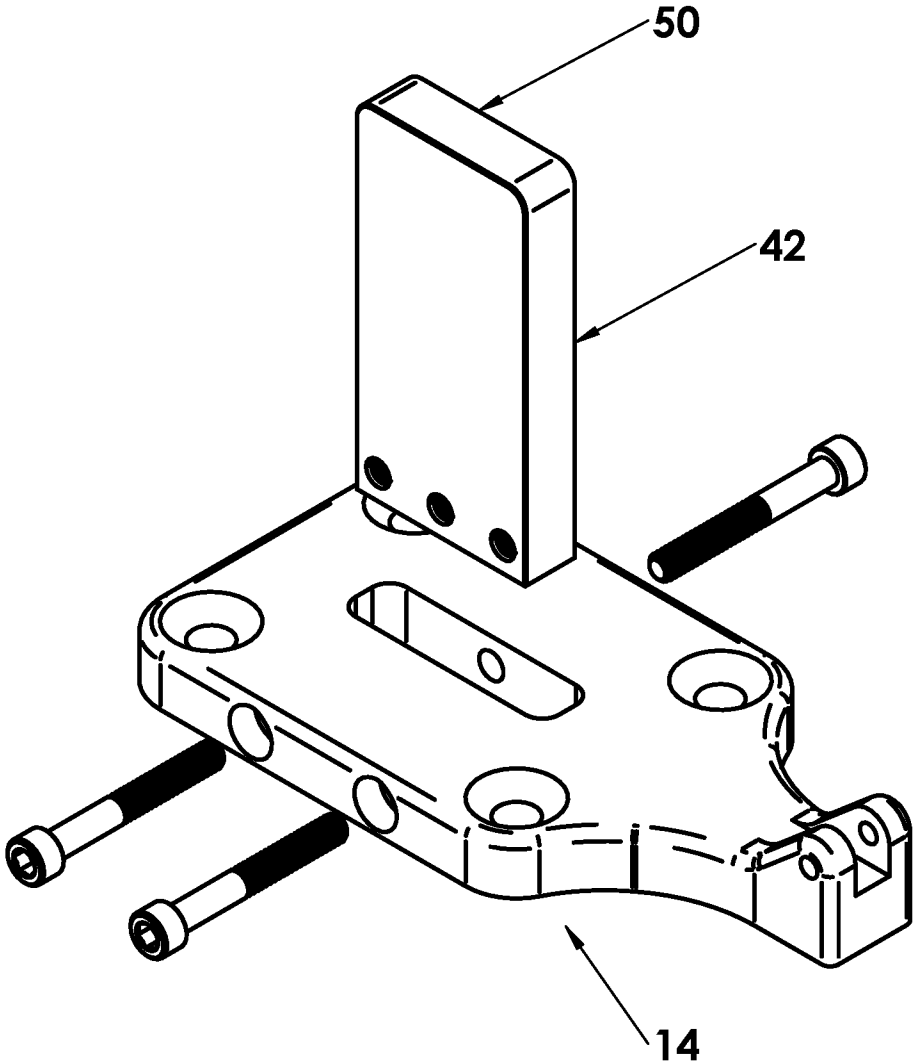
FIG. 10 illustrates an exemplary rear mount plate.

FIGS. 4 and 9 show an exemplary rear mount assembly 14. The rear platform projection 28 can include at least one guide block hole 40 configured to slidingly engage with the rear guide block 42. The rear guide block 42 extends essentially parallel with the perpendicular axis 70 and is positioned near the centerline axis 60 for providing proper heel force application. Sliding engagement of the suspension platform 16 guide block hole 40 with the rear guide block 42 provides positive heel force control while simultaneously providing central clearance 46 for the suspension system 24 to operate. The rear guide block 42 can be removably and adjustably coupled with the rear mount assembly 14 in a manner to allow the guide block 42 to pivot about the coupling in the fore and aft direction parallel to the centerline axis 60. A guide block cap 50, or similar device, can be secured to the top of the rear guide block 42 to limit travel of the suspension system 24 and prevent release of the suspension platform 16. The rear mount assembly 14 can be secured to the ski 22 with known hardware such as screws, glue, inserts, and the like.

Figure 5:
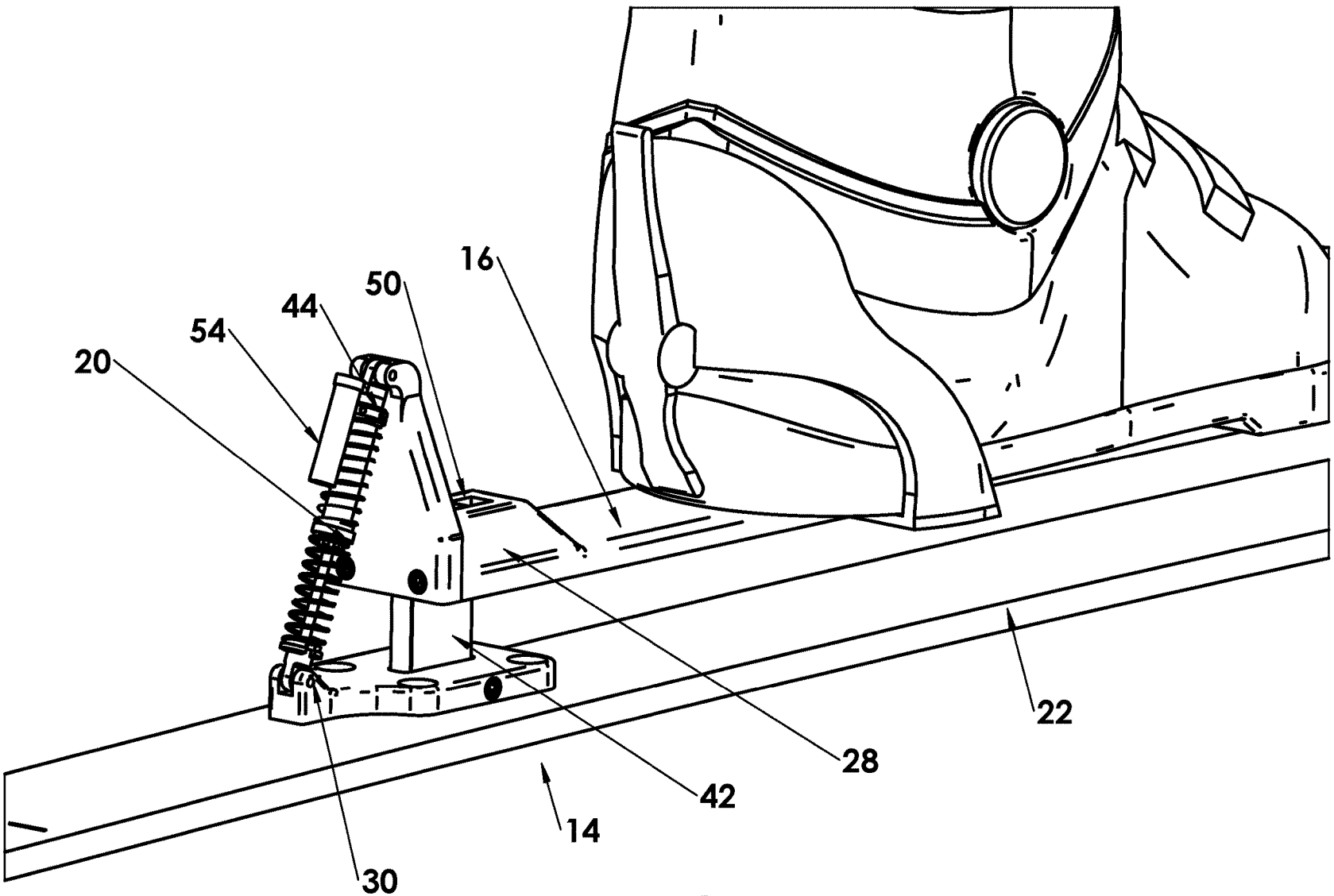
FIG. 5 illustrates an exemplary rear mount assembly.
Figure 6:
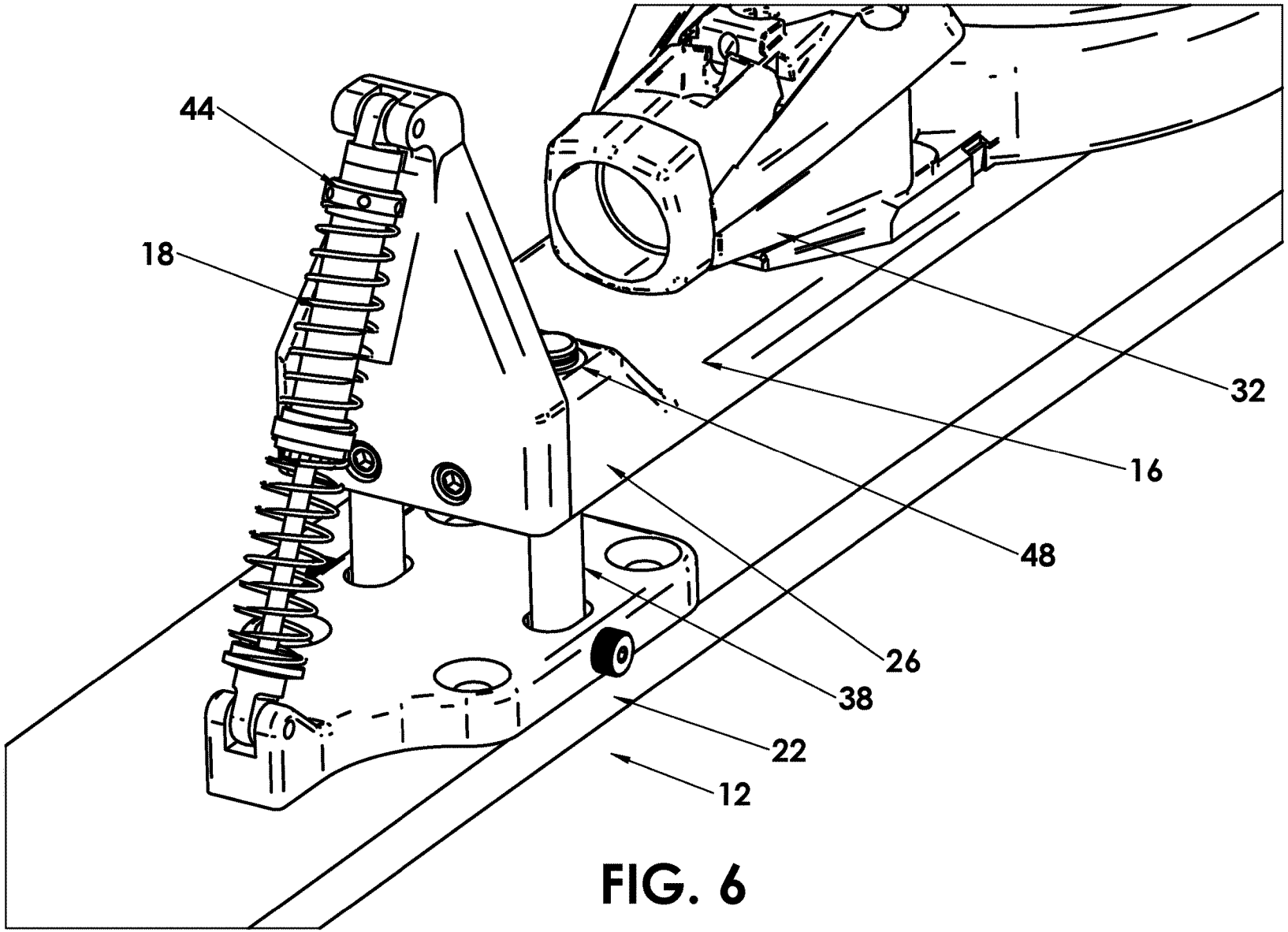
FIG. 6 illustrates an exemplary front mount assembly.
Figure 7:
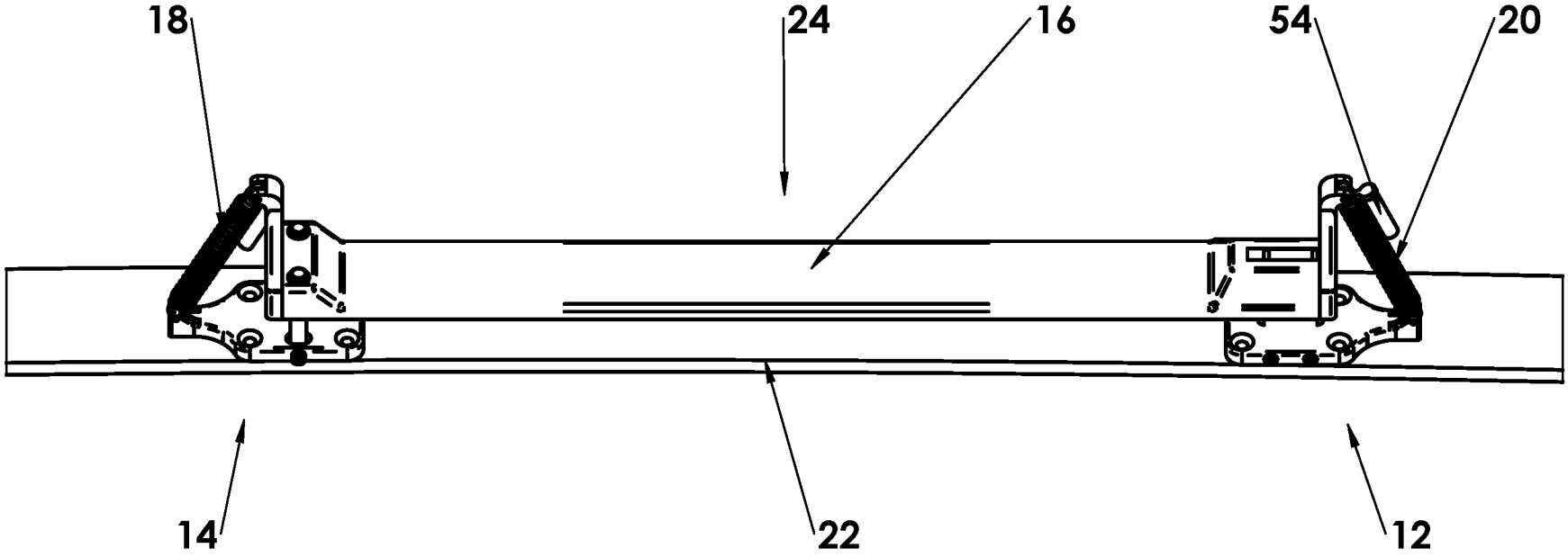
FIG. 7 illustrates a perspective view of an exemplary suspension system.
Figure 8:
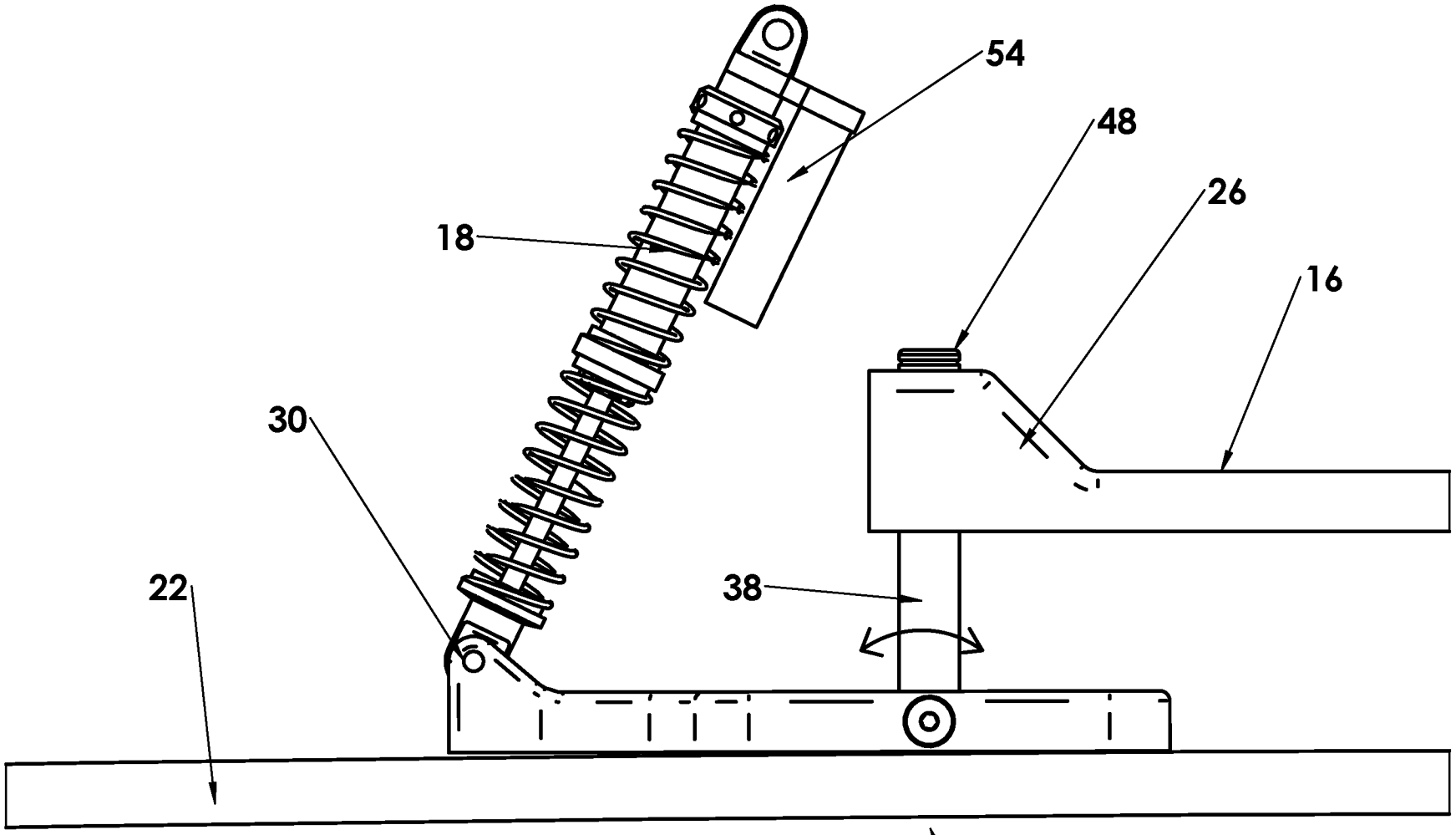
FIG. 8 illustrates an exemplary top view, side view, and front mount assembly.

FIGS. 5, 7, and 8 show an exemplary front mount assembly 12 that can include a front platform projection 26, including at least two post holes 36 configured to slidingly engage with the front mount assembly posts 38. The front mount assembly posts 38 extend essentially parallel with the perpendicular axis 70 and are positioned essentially equidistant from the centerline axis 60, in the range of about 10 mm to about 30 mm from the centerline axis 60, for providing proper edge control force application. Sliding engagement of the suspension platform 16 post holes 36 with the front mount assembly posts 38 provides positive edge control of the ski 22 while simultaneously providing central clearance 46 for the suspension system 24 to operate. The front mount assembly posts 38 can be removably and adjustably coupled with the front mount assembly 12 in a hinged manner to allow the posts 38 to pivot about the coupling in the fore and aft direction parallel to the centerline axis 60. Retainer rings 48, or similar devices, can be secured to the top of each front mount assembly post 38 to limit vertical travel of the suspension system 24 and prevent release of the suspension platform 16. The front mount assembly 12 can be secured to the ski 22 with known hardware such as screws, glue, inserts, and the like.

The front struts 18, are coupled with the suspension platform 16 at a flange on the front platform projection 26 to provide travel clearance for the front struts 18. Similarly, rear struts 20 are coupled with the suspension platform 16 at a flange on the rear platform projection 28 to provide travel clearance for the rear struts 20. The rotatable couplings 30 can be coupled with the front mount assembly 12, rear mount assembly 14, and the suspension platform 16 at different locations along the length of the ski 22 and the suspension platform 16, so as to allow the suspension platform 16 to be at different heights with respect to the ski 22, and to further allow the struts 18, 20 to couple with the front and rear mounting assemblies 12, 14 and suspension platform 16 at different angles, such as non-limiting angles ranging from 30 degrees to 130 degrees. The length of the struts 18, 20 can also be selected and/or adjusted to set the desired height of the suspension platform 16 from the ski 22. Additionally, by varying the location of the couplings 30 along the length of the ski 22 and the suspension platform 16, one is able to affect the stiffness of the suspension system 24 as well as the distance between the suspension platform 16 and the ski 22.

In some embodiments, the front mount assembly 12 and the rear mount assembly 14 use the same configuration comprising posts 38 and companion hardware. In some embodiments, the front mount assembly 12 and the rear mount assembly 14 use the same configuration comprising guide blocks 42 and companion hardware. In some embodiments, posts 38 and guide blocks 42 are used together in either the front mount assembly 12 or the rear mount assembly 14, or both.

In some embodiments, the suspension system 24 is configured similar to other anti-vibration plates used in competition skiing, meeting all International Ski Federation (FIS) specifications. The suspension platform 16 is configured such that the width of the platform 16 does not exceed the width of the ski 22. Also, the suspension system 24 is configured so that the maximum height, or central clearance 46 between the bottom of the running surface of the ski 22 and the ski boot 34 sole, does not exceed 50 mm. The maximum height, or central clearance 46 can be changed in various ways, for example, by adjusting the distance between the ski boot sole and the suspension platform 16, changing the type of boot binder, moving the connection point of the rotatable couplings 30 at the front and rear mount assemblies 12, 14 or front and rear platform projections 26, 28, changing or adjusting the struts 18, 20, changing the positions of the retainer rings 48 on the posts 38, changing the position of the guide block cap 50 on the rear guide block 42, and combinations thereof.

In other embodiments, the central clearance 46 can be set in the range of about 20 to about 160 mm. Adjustments can be made to match the weight, style and performance level of the skier as well as adjusting for changing slope and snow conditions.

Each of the front and rear struts 18, 20 can include at least one of a shock absorber, a bump stop, a spring, a reservoir, and combinations thereof. An example of the struts 18, 20 can be the suspension products manufactured by King Shock Technology, Inc., such as the UTV performance products. The dampening force of the front and rear struts 18, 20 can be adjusted, for example, with an adjustment collar 44 on the strut body. Optionally, the front and rear struts 18, 20 can have a remote or piggyback reservoir 54 engaged with the bolt-on monotube shock that enables internal bypass for precise tuning of velocity sensitive and position sensitive damping as well as a hydraulic bump stop. Mounted to the shaft below the standard piston in the struts 18, 20, a second set of valving is housed in a chamber that contains valve shims and port openings that allow fluid to bypass the standard piston by flowing through ports into the strut's hollow shaft. Each strut can be individually adjusted for matching the weight, style and performance level of the skier as well as adjusting for changing slope and snow conditions.

In some embodiments, the ski 22 is configured as a snowboard 52 with two bindings 32 mounted on the suspension platform 16 and the bindings 32 positioned for snowboarding. The bindings 32 would generally be plate-type bindings typically used on snowboards. The suspension system 24 comprises a suspension platform 16, four struts, two front struts 18 and two rear struts 20, and eight rotatable couplings 30. Each strut is coupled with the snowboard 52 at a front mount assembly 12 or rear mount assembly 14 and coupled with the suspension platform 16 at a front platform projection 26 or a rear platform projection 28. At least two posts 38 and rear guide blocks 42 are positioned to stabilize the snowboard 52 during use. In this embodiment, a centerline axis 60 is defined as parallel with the length of the snowboard and centered on the width of the snowboard. A perpendicular axis 70 is defined as perpendicular to the centerline axis 60 snowboard. The suspension platform 16 operates to absorb shock and vibration generated during use of the snowboard so as to provide a smoother ride for users. Each suspension platform 16, front mount assembly 12, and rear mount assembly 14 may be made from a metal, composite material or other suitable material compatible with conventional snowboard construction. Each suspension platform 16 can include a binding 32 configured to secure a boot 34 to the suspension platform 16. The binding 32 is configured to release the boot 34 from the suspension platform 16 when pressure exerted on the binding 32 exceeds the release settings.

The foregoing explanations, descriptions, illustrations, examples, and discussions have been set forth to assist the reader with understanding this invention and further to demonstrate the utility and novelty of it and are by no means restrictive of the scope of the invention. It is the following claims, including all equivalents, which are intended to define the scope of this invention.

The invention claimed is:

1. A ski assembly, comprising:

a ski comprising a centerline axis, a perpendicular axis, and a ski running surface;

at least one ski boot comprising a ski binding and a ski boot sole; and a ski suspension system, comprising:

a suspension platform; and two or more struts extending between the suspension platform and a front mount assembly or a rear mount assembly, each strut comprising a first end and a second end, each of the two or more struts rotatably coupled with the suspension platform on the first end, and rotatably coupled with the front mount assembly or the rear mount assembly on the second end;

wherein the suspension platform and the ski are coupled such that there is an adjustable central clearance between said ski running surface and said ski boot sole;

wherein resultant forces between the ski and the suspension platform are exerted only via the two or more struts;

wherein the suspension platform is configured to absorb shock and vibration generated during use of the ski assembly; and wherein the suspension platform comprises a front platform projection further comprising at least two post holes configured to slidingly engage with at least two front mount assembly posts and at least one strut.

2. The ski assembly of claim 1, wherein the front mount assembly posts extend essentially parallel to the perpendicular axis and are positioned essentially equidistant from the centerline axis, in the range of about 10 mm to about 30 mm from the centerline axis.

3. The ski assembly of claim 1, wherein the at least two front mount assembly posts are removably and adjustably coupled with the front mount assembly in a hinged manner to allow the at least two front mount assembly posts to pivot about the coupling.

4. The ski assembly of claim 1, wherein each front mount assembly post comprises a retainer clip configured to limit vertical travel and prevent release of the suspension platform.

5. The ski assembly of claim 1, wherein the suspension platform comprises a rear platform projection further comprising at least one guide block hole configured to slidingly engage with a rear guide block extending from the rear mount assembly.

6. The ski assembly of claim 5, wherein the rear guide block extends essentially parallel to the perpendicular axis and is positioned near the centerline axis.

7. The ski assembly of claim 5, wherein the rear guide block is removably and adjustably coupled with the rear mount assembly in a hinged manner to allow the rear guide block to pivot about the coupling.

8. The ski assembly of claim 5, further comprising a guide block cap secured to the rear guide block and configured to limit travel and prevent release of the suspension platform.

9. The ski assembly of claim 1, wherein the two or more struts comprise at least one of a shock absorber, a bump stop, a spring, a reservoir, and combinations thereof.

10. The ski assembly of claim 1, wherein the two or more struts further comprise an adjustment collar to adjust the strut dampening force.

11. The ski assembly of claim 1, wherein the two or more struts comprise an internal bypass configured for precise tuning of velocity sensitive and position sensitive damping.

12. The ski assembly of claim 1, wherein the ski comprises a snowboard.

13. A method of absorbing shock and vibration generated during use of a ski assembly, comprising;

coupling at least one ski boot of a skier to a ski binding, the ski binding coupled with a ski assembly comprising a ski and a ski suspension system, the ski suspension system further comprising a suspension platform, having a front platform projection further comprising at least two post holes configured to slidingly engage with at least two front mount assembly posts and at least one strut, and two or more struts extending between the suspension platform and a front mount assembly or a rear mount assembly, each strut comprising a first end and a second end, each of the two or more struts rotatably coupled with the suspension platform on the first end, and rotatably coupled with the front mount assembly or the rear mount assembly on the second end;

adjusting the central clearance between a ski running surface and a ski boot sole; and applying resultant front and rear forces through the ski suspension system only via the two or more struts to absorb shock and vibration generated during use of the ski assembly.

14. The method of claim 13, further comprising;

applying a portion of the resultant front forces through front mount assembly pins positioned equidistant from the centerline axis to stabilize the suspension system apply force on the edges of the ski.

15. The method of claim 14, further comprising;

applying a portion of the resultant rear forces through a rear mount assembly rear guide block positioned along the centerline axis to stabilize the suspension system apply force on the center of the ski.

16. The method of claim 15, further comprising;

applying a portion of the front and rear forces through the struts comprising at least one of a shock absorber, a bump stop, a spring, a reservoir, and combinations thereof.

17. The method of claim 16, further comprising;

adjusting a collar on the two or more struts to set a predetermined damping force.

18. The method of claim 13, wherein the central clearance is 50 mm or less.

19. The method of claim 13, wherein the ski comprises a snowboard.

* * * * *